US005310163A

United States Patent [19]

Waite

[11] Patent Number: 5,310,163

[45] Date of Patent: May 10, 1994

[54] BARRIERS

[76] Inventor: David P. Waite, P.O. Box 51, Hampkins Hill Road, Chiddingstone, Edenbridge, Kent TN8 7QH, England

[21] Appl. No.: 46,909

[22] Filed: Apr. 14, 1993

Related U.S. Application Data

[63] Continuation of Ser. No. 728,281, Jul. 11, 1991, abandoned.

[30] Foreign Application Priority Data

Jun. 13, 1989 [GB] United Kingdom ..... 8913605.5
Mar. 15, 1990 [GB] United Kingdom ..... 9005824.9
Nov. 17, 1990 [DE] Fed. Rep. of Germany ..... 9015767

[51] Int. Cl.[5] ..... E04H 17/00

[52] U.S. Cl. ..... 256/11; 256/12; 256/16; 256/18; 256/8; 29/6.1; 29/7.1; 72/367

[58] Field of Search ..... 256/12, 16, 11, 18, 256/8; 29/7.1, 6.1, 889.7; 72/367

[56] References Cited

U.S. PATENT DOCUMENTS 861,559 7/1907 Trost ..... 256/12
1,595,564 8/1926 Neuhaus ..... 72/367
4,270,736 6/1981 Burch ..... 256/12
4,348,012 9/1982 McLoughlin ..... 256/12
4,621,421 11/1986 O'Loughlin ..... 72/367
4,739,970 4/1988 Francis ..... 256/12

FOREIGN PATENT DOCUMENTS

20970/88 2/1990 Australia .
380265 9/1923 Fed. Rep. of Germany ..... 256/12
1187 of 1907 United Kingdom ..... 256/16
2076038 11/1981 United Kingdom .

*Primary Examiner*—Randolph A. Reese
*Assistant Examiner*—Christopher J. Novosad
*Attorney, Agent, or Firm*—Nixon & Vanderhye

[57] ABSTRACT

A barrier is fixed on a wall or other perimeter structure by way of support posts. The barrier has a support shaft along which a number of rotatable units are mounted. Each rotatable unit is formed from two interengaged elements, each element having been formed from a length of metal tubing. Part of the tubing has been cut longitudinally to define blades extending from one end of a tubular portion, and splayed outwardly and spaced apart. Two such elements are assembled so that their blades interengage to form one of the units. The rotatable units so constructed are simple to manufacture, but provide an effective barrier.

13 Claims, 3 Drawing Sheets

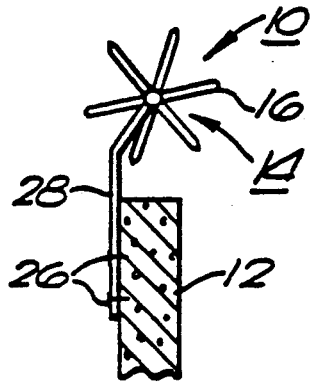
FIG. 1
FIG. 3
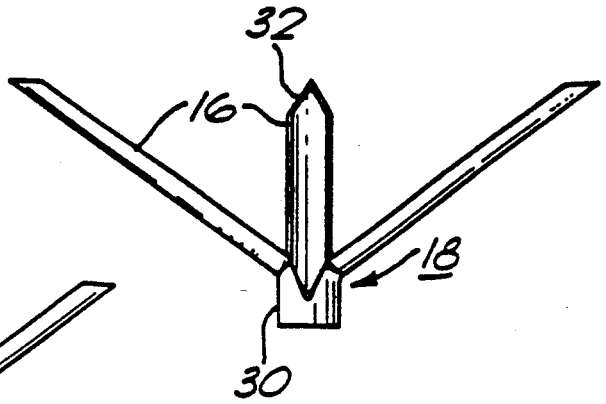
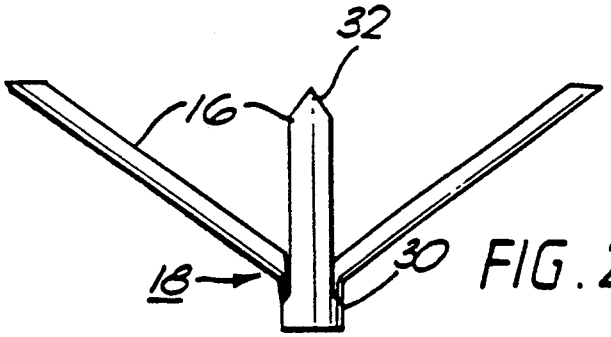
FIG. 2
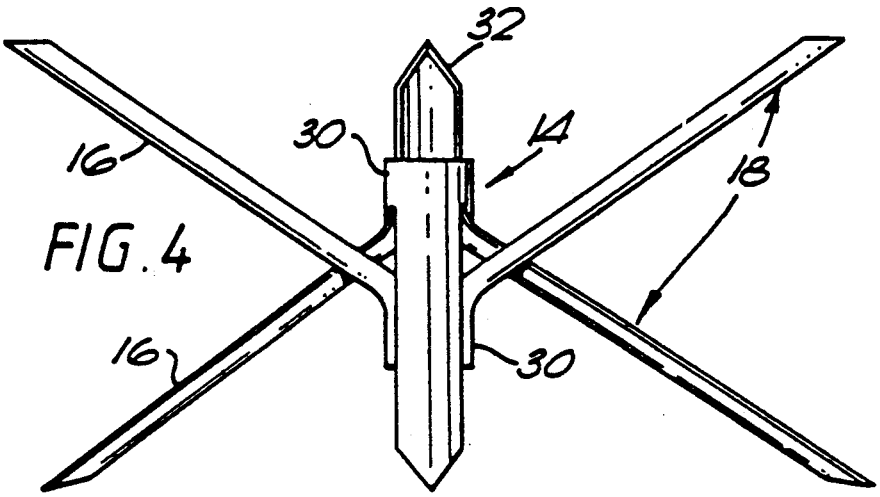
FIG. 4

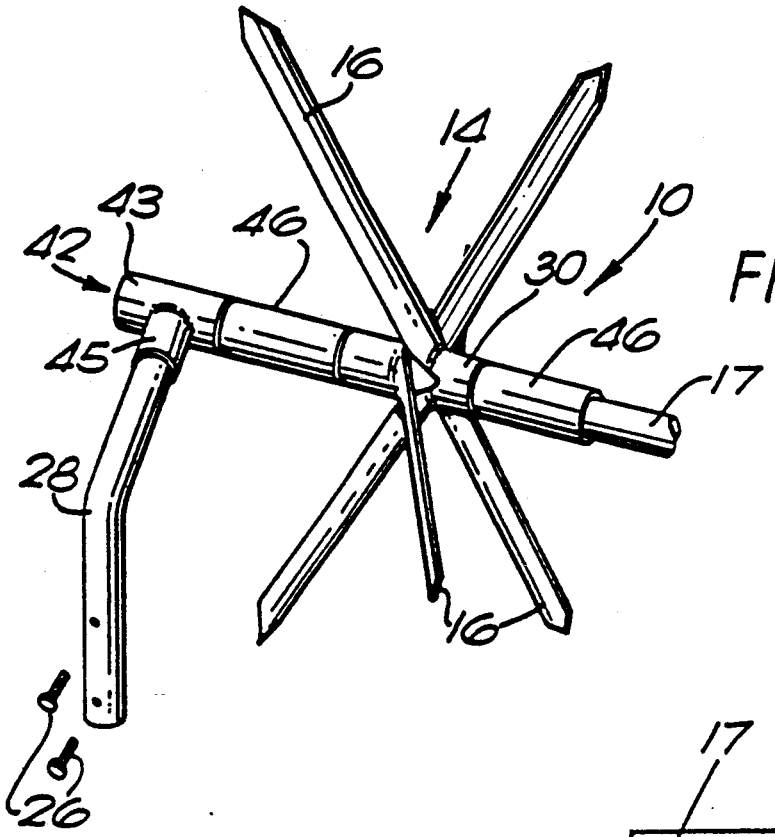
FIG. 5
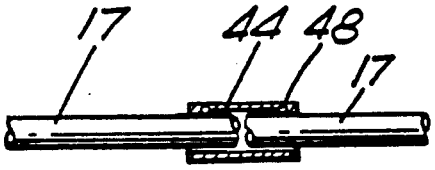
FIG. 6
FIG. 8
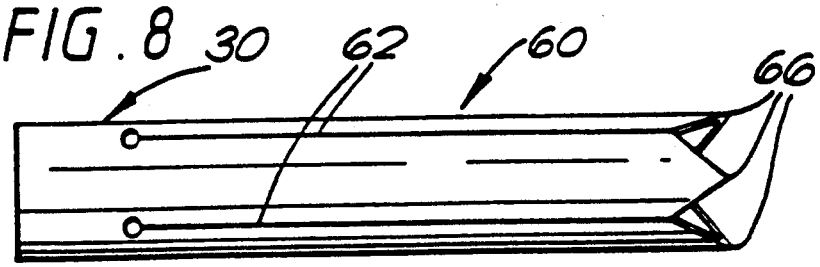
FIG. 10
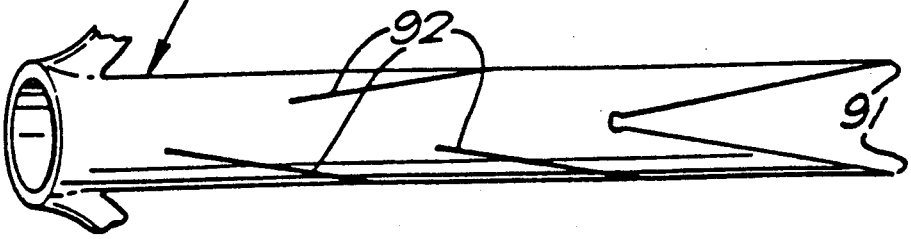

BARRIERS

This is a continuation of application Ser. No. 07/728,281 filed Jul. 11, 1991, now abandoned.

BACKGROUND TO THE INVENTION

The present invention relates to barriers, for example, for fixing along the tops of walls, fences, and other perimeter structures.

Traditionally, broken glass, spikes and the like has been used on the top of perimeter structures to deter intrusion. Not only does this have an unpleasant appearance, it is relatively easy for intruders to climb over the fixed obstacles without problem. Increasingly therefore, barriers with movable spikes and blades are being used as such barriers are very much more difficult for intruders to circumvent.

However, the barriers with movable parts which are currently available are costly to construct, difficult to install, and have a particularly unpleasant appearance.

SUMMARY OF THE INVENTION

It is an object of the present invention to provide an improved barrier.

According to a first aspect of the present invention there is provided a barrier comprising a support shaft, and a plurality of units each rotatably supported on said support shaft, wherein each said unit is formed of a pair of elements which each comprise a tubular portion through which said shaft extends, and a plurality of blades extending outwardly of said tubular portion, the blades of the elements of the pair being interengaged.

The elements of the rotatable units are interengaged, and thereby obviate the need for welding. It is a simple matter to construct each said unit, and the resultant units are strong and easily mounted on the support shaft. It is also difficult to deform the units to prevent their rotation.

Preferably, said support shaft is formed of a number of aligned lengths of shaft fastened together end to end.

In an embodiment, the adjacent ends of two lengths of shaft are connected by a respective connector comprising a tubular member in which the end of each length of shaft is received, and fastening means for securing said connector to the two ends whereby the two ends are fixed relative to one another. Each said connector may be located between the tubular portions of the pair of elements of one said unit.

In an embodiment, support means are provided for fixing the barrier to a perimeter structure. The support means may comprise a number of support connectors each fixed to said support shaft, and a respective support post fixed to each said support connector. Each said support connector may comprise a first tubular portion in which said support shaft is arranged to extend, and a second tubular portion connected to and extending substantially at right angles to said first tubular portion and to which a respective support post is to be fixed.

Preferably, a plurality of tubular spacer members are arranged to be supported on said support shaft to space adjacent units apart. Generally, said units are spaced substantially equidistantly along said support shaft.

In a preferred embodiment, each said element comprises a tubular portion, and a plurality of blades extending from said tubular portion, wherein said blades extend outwardly at an angle to the axis of said tubular portion and are spaced apart. For example, each said element may have been formed by cutting part of a length of hollow tubing longitudinally to define said plurality of blades, an uncut portion defining said tubular portion.

The invention also extends to an element for a barrier comprising a tubular portion, and a plurality of blades extending from said tubular portion, wherein said blades extend outwardly at an angle to the axis of said tubular portion and are spaced apart.

Preferably, said blades extend from one end of the tubular portion.

Said blades are preferably longitudinally curved and extend to surround said tubular portion.

Preferably, each said blade is curved transversely to its longitudinal extent. One or more points may be formed at the free end of each said blade, and/or one or more barbs may be formed on the or each said blade.

In an embodiment, the element has been formed from a length of hollow tubing, part of the tubing having been cut longitudinally to define said plurality of blades and to define an uncut end forming said tubular portion.

According to a further aspect of the invention there is provided a method of forming an element comprising the steps of forming a plurality of elongate cuts along part of a length of hollow tubing to define a plurality of blades extending from one end of an uncut tubular portion, and splaying the defined blades outwardly.

BRIEF DESCRIPTION OF THE DRAWINGS

Embodiments of the present invention will hereinafter be described, by way of example, with reference to the accompanying drawings, in which:

FIG. 1 shows schematically an end view of a barrier of the invention in situ on a perimeter wall;

FIG. 2 shows an elevational view of an element of the barrier of FIG. 1;

FIG. 3 shows a further elevational view of the element of FIG. 2 rotated through 180;

FIG. 4 shows an elevational view of a unit of the barrier of FIG. 1 formed from a pair of the elements of FIGS. 2 and 3;

FIG. 5 shows a perspective view of part of the barrier of FIG. 1 illustrating a unit as shown in FIG. 4;

FIG. 6 is a cross-sectional view illustrating the connection of support shafts of the barrier of FIG. 5;

FIG. 8 illustrates the formation of an element of FIGS. 2 and 3 from a length of tubing;

FIG. 10 shows the formation of barbs on an element of FIG. 2 or FIG. 7.

DESCRIPTION OF PREFERRED EMBODIMENTS

Figure 7:
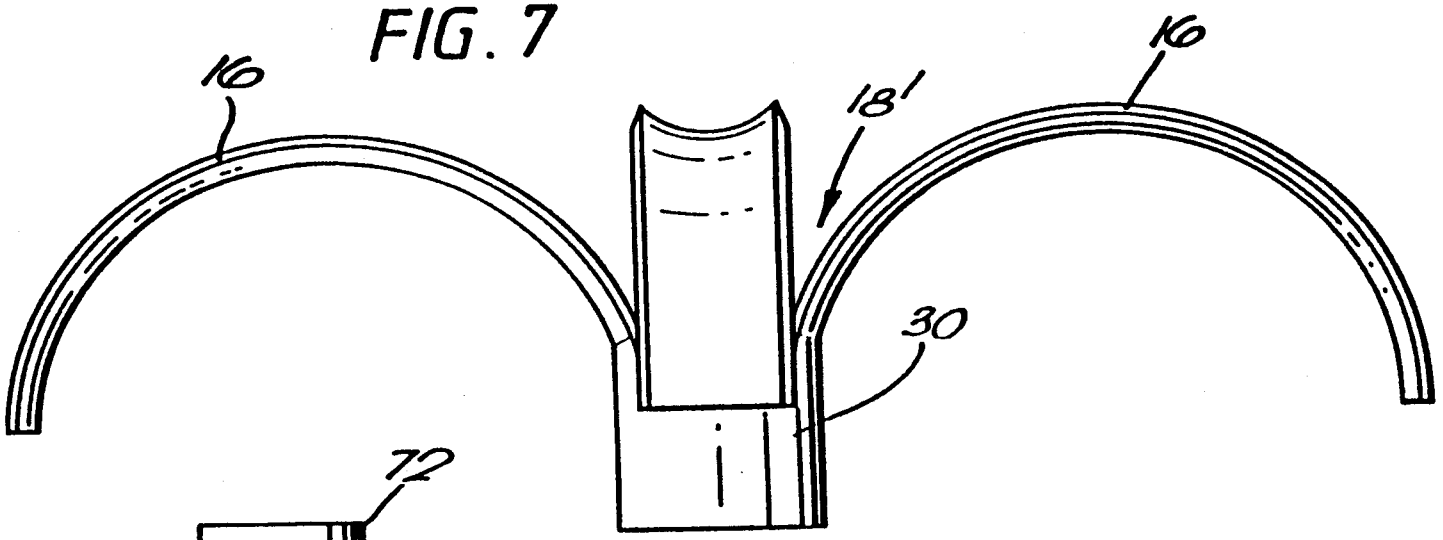
FIG. 7 shows an elevational view of an alternative embodiment of an element of the barrier.

The present invention relates to a barrier to be provided along the top of a wall, fence or other perimeter structure. The barrier is designed to prevent intruders climbing over the top of the perimeter structure.

FIG. 1 shows schematically an end view of a barrier generally indicated at 10, which is fixed to extend along the top of a wall 12. As will be seen, this barrier 10 comprises a plurality of rotatably mounted units, generally indicated at 14, each of which has a number of outwardly extending blades 16. As can be seen in FIG. 5, the units 14 are each rotatably supported on a support shaft 17 which is mounted to extend along the top of the wall 12.

Support means are provided for fixing the barrier 10 to the wall 12. In the embodiment illustrated, the support means comprise a number of support posts 28 connected to the support shaft 17 along its length. Each said support post 28 is connected to the wall 12 to fix the barrier 10 in position. In this respect, each said support post 28 is preferably cranked so that it can be connected, for example by screws 26, to the inner surface of the wall 12. This denies access to any intruder to the screws 26 or other fixing means, whereby removal of the barrier to gain access is prevented. Preferably, the support posts 28 are sized and shaped such that the shaft 17 of the barrier 10 extends along the top of the wall approximately centrally of its inner and outer surfaces.

Each of the rotatable units 14 is formed from a pair of inter engaged elements 18. An elevation of one element 18 is shown in FIG. 2, and the same element rotated through substantially 180° is shown in FIG. 3. As can be seen, each said element 18 comprises a hollow tubular portion 30 from one end of which a plurality of blades 16 extend. It will be seen that these blades 16 extend outwardly at an angle to the longitudinal axis of the tubular portion 30 and are spaced apart.

As will be described below, the element 18 is preferably formed from a length of hollow tubing of a suitable material, such as steel. Thus, the blades 16 may be formed by longitudinally cutting the tubing to define the blades, and then splaying the blades outwardly. Preferably, and as shown, at least one point is formed at the free end of each blade 16. Where the blades 16 have been formed from a length of tubing, they will each be curved transversely to its longitudinal extent. The provision of a transverse curvature is preferred as it causes the longitudinal edges of each blade 16 to be upstanding.

In the embodiment shown in FIGS. 2 and 3, the element 18 is shown to have three spaced blades 16. It would, of course, be possible to provide the element with a different number of blades.

The blades 16 each extend at an acute angle relative to the longitudinal axis of the tubular portion 30 of the element 18. This, as is illustrated in FIG. 4, enables a pair of the elements 18 to be interengaged to form a unit 14. Thus, FIG. 4 shows a pair of the elements 18 arranged with their tubular portions 30 aligned and with their blades 16 facing each other. The two elements 18 have been rotated relative to one another such that each blade 16 of one element is aligned with the space between two adjacent blades of the other element. The two elements 18 have then been moved towards one another so that their blades 16 have interengaged and effectively locked the elements together to form a single rotatable unit 14. It will be appreciated from FIG. 4 that in this configuration the blades 16 of each element 18 act to maintain the spacing of the blades 16 of the other element and thereby enhance the strength of the unit 14. Furthermore welding is not required to hold the unit together, such that its construction is simple. It is also difficult to deform a unit as 14 to prevent its rotation.

The barrier 10 comprises a plurality of units as 14 spaced along the support shaft 17 and arranged to be rotatable with respect thereto. As is indicated in FIG. 5, the support shaft 17 extends through the two tubular portions 30 of each said unit 14. A tubular spacer member 46 is arranged on the support shaft 17 at either side of each unit 14 whereby each spacer member 46 spaces two adjacent units 14 apart. The spacer members 46 are generally equal in length so that the barrier 10 comprises a number of aligned and regularly spaced units 14.

The support posts 28 which fix the barrier 10 to the wall 12 or other perimeter structure are, as is shown in FIG. 5, each connected to the support shaft 17 by a respective support connector 42. In the embodiment illustrated in FIG. 5, the support connector 42 is provided on the shaft 17 adjacent to a spacer member 46, but it would be possible to replace the spacer member 46 with a support connector 42. As can be seen, the support connector 42 is generally T-shaped and comprises a first tubular portion 43 in which the shaft 17 is arranged to extend. Where a support connector 42 is provided at an intermediate location along the length of the barrier 10, its first tubular portion 43 will enable the shaft 17 to extend therethrough. However, if the connector 42 is to be provided at an end of the barrier 10, a respective end of the tubular portion 43 will be closed to prevent access to the shaft 17. A second tubular portion 45, in which the support post 28 is received, extends substantially at right angles to the first tubular portion 43. The second tubular portion 45 may have a blind end, or may tap into the first tubular portion 43. One end of the support post 28 is inserted into the second tubular portion 45 and is secured therein by any suitable means. For example, the support post 28 is welded or fixed by screws (not shown), to the support connector 42. It will be appreciated that this construction enables the support posts 28 to extend generally transversely to the longitudinal extent of the support shaft 17.

Preferably, each said support connector 42 is substantially the same length as a spacer member 46, and when a support connector 42 is provided it is preferably arranged to space two rotatable units 14. It is because of this dual use of these connectors 42 that it is possible to simply fix them onto the support posts 28 using screws. Thus, where the connectors 42 are spacing two adjacent units 14, the blades 16 of the units 14 can be arranged to extend over the adjacent connector 42 and therefore prevent access to the screws or any other fixing means.

It would be possible to form the barrier 10 using just a single shaft 17 of the required length. However, for ease of providing barriers of any required length, it is preferred that a number of shafts 17 of standard length are utilised. The adjacent ends of adjacent lengths of shaft 17 are connected together to form a shaft 17, and hence the barrier 10, of the required length. Thus, and as can be seen in FIG. 6, a connector 44 is provided which comprises a tubular member into which adjacent ends of two adjacent shafts 17 are received. The connector 44 is secured to the two ends of the shafts 17 by fastening means, for example, in the form of screws 48. Preferably, each said connector 44 is arranged between the tubular portions 30 of a pair of elements 18 forming a rotatable unit 14. As the connector 44 is within a unit 14, and surrounded by the blades 16 of the unit, an intruder is denied access to the screws 48 or other fastening means.

It will be apparent from the description above that a barrier 10 of any length can be simply assembled. Thus, a plurality of support posts 28 are fixed along the length of the perimeter structure. The barrier 10 is then assembled from one end by fixing a first shaft 17 to an end post 28 by way of a connector 42 and then sliding along the shaft 17 in the required sequence the units 14 and their spacer members 46 and any required connectors 44. Additional lengths of shaft are secured to the shaft 17 by way of connectors 44 as required.

When the barrier 10 has been erected, it provides a very effective barrier against intruders. Any intruder trying to climb over the structure on which the barrier 10 is provided will find it difficult to grasp any part of the barrier 10 other than the units 14 because the blades 16 extend over adjacent connectors 42 and spacer members 46. If a unit 14 is grasped, it will rotate around the shaft 17 and thereby prevent the intruder climbing over the barrier. Of course, it is very difficult to actually grasp a rotatable unit 14 because of the upstanding longitudinal edges of the blades 16, of their pointed ends, and any barbs provided thereon. Furthermore, the intruder is denied access to the various fixing means of the barrier and therefore cannot dismantle it. The very existence of such an effective barrier as that described above also has a very strong deterrent effect. However, an advantage of the barrier shown in the drawings is that it has a much more pleasing appearance than other barriers of this nature whilst being just as effective.

If it was required, elements in addition to the units 14 could also be spaced along the shaft 17 of the barrier 10. For example, the spacer members 46 could carry a plurality of radially extending projections and/or annular members having a central aperture and a spiked outer circumference could also be supported at chosen locations along the shaft 17. For example, such additional annular members could be interposed between the two elements 18 of a unit 14.

FIG. 7 shows an elevation of an alternative element 18' for forming a rotatable unit. As previously, the element 18' comprises a tubular portion 30 from one end of which three outwardly extending blades 16 extend. Again, the element 18' is preferably formed from a length of tubing, such that each of the blades 16 is curved transversely to its length. However, as is shown in FIG. 7, the longitudinal extent of each of the blades 16 is also curved so that the free ends of each blade 16 surround the tubular portion 30. However, it will be appreciated that the curvature of the blades 16 is such that at their ends connected to the tubular portion 30 they extend outwardly at an angle to the longitudinal axis of the tubular portion 30 to facilitate the interengagement with the blades of a similarly shaped element 18'.

Figure 9B:
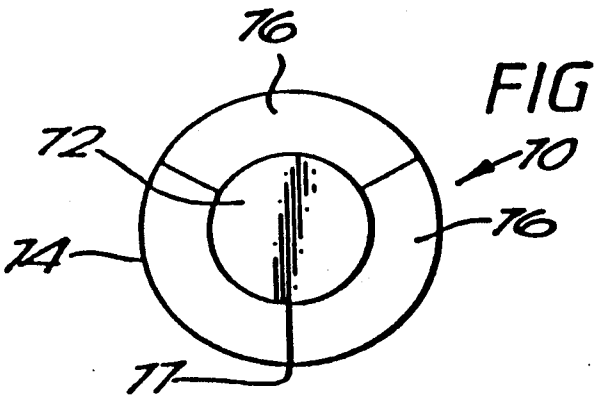
FIG. 9B shows a plan view of the tool of FIG. 9A.
Figure 9A:
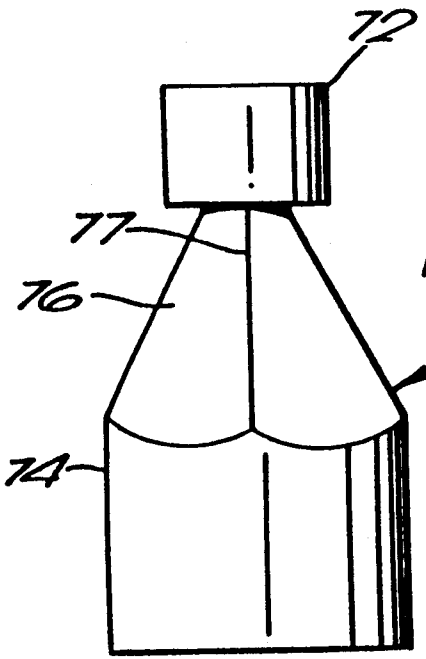
FIG. 9A shows in elevation a tool for forming element of the barrier from tubing.

Methods of forming the elements 18 or 18' are illustrated by FIGS. 8, 9A, and 9B. FIG. 8 shows a length of steel tubing 60 having a circular cross-section. Three elongate cuts 62 are formed to extend longitudinally from one end of the tubing 60 and are spaced at 120° around its circumference. These cuts 62 thereby define three blades. At one end, the tubing 60 is left uncut to define the tubular portion 30. One or more points, as the points 66 are formed at the free end of each defined blade.

It will be appreciated that once the tubing 60 has been formed as shown in FIG. 8, it is only then necessary to splay the blades 16 outwardly, and to give them any required longitudinal curvature, to produce an element 18 or 18'. The blades 16 could be defined and splayed, for example, by the use of a pair of rollers with different hardnesses as is used in curving elongate metal elements.

In a preferred embodiment, the tubing 60 is not cut and then splayed in two separate operations. Instead, the tool 70 illustrated in FIGS. 9A and 9B is used to perform both operations simultaneously. The tool shown in FIGS. 9A and 9B is a circular cross-section former having a cylindrical body 74 and a shaped end 75. In this respect, the end 75 is formed to have three substantially planar surfaces 76 defining a taper and arranged to define between them respective raised, longitudinally extending edges 77. At the apex of the taper a cylindrical head 72 is provided.

The external diameter of the head 72 is chosen to be larger than the inner diameter of a length of tubing which is to be formed into an element 18 or 18'. For example, the outer diameter of the head 72 could be of the order of 0.2 to 0.3 mm larger than the tubing's inner diameter.

In use, the tubing (not shown) is appropriately supported with its end which is to form the tubular portion 30 constrained. The tool 70 is then driven into the end of the tubing opposite to its constrained end, the longitudinal axes of the tool and the tubing being aligned. Sufficient force is used to force the head 72 into the tubing. It will be appreciated that the head 72 will initially cause the tubing to be stretched as it enters the tubing. It will also be appreciated that the body 74 of the tool 70 has a much larger diameter than that of the head 72. As the taper is forced progressively into the tubing, its edges 77 cause the tubing to split whereby the blades are formed. In this respect, the shape of the taper also causes the formed blades to be splayed outwardly as is required. The insertion of the tool 70 into the tubing is appropriately halted so as to form the tubular portion 30.

The tubing, and the tool 70 to be driven therein, need to be longitudinally aligned, but otherwise can be in any orientation. However, it is generally preferred that the tubing be arranged to extend substantially vertically with the tool applied from above, as this enables the required forces to be developed very simply.

The formed blades of the resultant element 18 or 18' may subsequently be cut at their free ends to form one or more points, if required. Further shaping of the blades may be undertaken to form the blades to have the required curvature and spacing.

In a preferred embodiment, each element 18 or 18' is formed from tubing of a suitable steel and is approximately 30 cm long. In this case, the tubular portion 30 will generally be of the order of 10 cm long.

If required, the blades 16 of the elements 18 or 18' may be additionally provided with barbs and the like. The blade 16 shown in FIG. 10 has had its free end cut to form two spaced points 91. In addition, angled cuts 92 extending from longitudinal edges of the blade have been formed. The material of the blade outwardly of each cut 92 can subsequently be deformed away from the blade to define barbs.

It will be appreciated that the provision of barbs or the like on the blades increases the number of sharp edges on each said unit 14 and their relative directions. This makes it extremely difficult to grasp the units 14 if trying to climb over the barrier 10. The provision of additional barbs and the like also makes the barrier look more forbidding.

The barrier 10 can of course be formed of any suitable material. It is important that the shafts 17 are not only self-supporting, but are able to support the elements engaged thereon. Generally therefore the shafts 17 would always be made of metal, such as steel. However, the other elements may be made of metal or plastics material or any other suitable material. If the elements are made of a metal which is affected by the elements, for example of an iron subject to rust, the metal is preferably suitably treated against the results of such exposure.

The elements 18 or 18' are particularly simple to manufacture, and effectively and simply engage with a second such element to form an effective rotatable unit. In addition, the elements 18 and 18' can be stacked for ease of transport to the site. In this respect, the tubular end portion of one element can be received between the blades of a second element and engage with its tubular portion.

It will be appreciated that alterations and modifications to the invention described above can be made within the scope of this application.

I claim:

1. A barrier comprising an elongate support shaft, and a plurality of units arranged along and supported by said support shaft, each said unit being rotatably supported on said support shaft, wherein each said unit comprises a pair of elements, each said element having a tubular portion through which said support shaft extends, and each said element having a plurality of blades extending outwardly of said tubular portion, wherein the blades of the elements of each pair are interengaged to form said unit, such that a blade of one of said pair of elements extends and intersects between two adjacent blades of another of said pair of elements, and wherein said support shaft is formed of a number of aligned lengths of shaft each having two spaced ends, and wherein adjacent ends of adjacent lengths of shaft are fastened together.

2. A barrier according to claim 1, further comprising at least one connector connecting the adjacent ends of two lengths of shaft, said connector comprising a tubular member in which each of the ends of the adjacent lengths of shaft is received, and further comprising fastening means for securing said connector to the two ends whereby the two ends are fixed relative to one another.

3. A barrier according to claim 2, wherein the or each said connector is located between the tubular portions of the pair of elements of one said unit.

4. A barrier according to claim 1, further comprising support means for fixing the barrier to a perimeter structure.

5. A barrier according to claim 4, wherein said support means comprises a number of support connectors each fixed to said support shaft, and a respective support post fixed to each said support connector.

6. A barrier according to claim 5, wherein each said support connector comprises a first tubular portion in which said support shaft is arranged to extend, and a second tubular portion connected to and extending substantially at right angles to said first tubular portion and to which a respective support post is to be fixed.

7. A barrier according to claim 1, further comprising a plurality of tubular spacer members arranged to be supported on said support shaft to space adjacent units apart.

8. A barrier according to claim 1, wherein said units are spaced substantially equidistantly along said support shaft.

9. A barrier comprising an elongate support shaft, and a plurality of units arranged along and supported by said support shaft, each said unit being rotatably supported on said support shaft, wherein each said unit comprises a pair of elements, each said element having a tubular portion through which said support shaft extends and a plurality of blades extending outwardly of said tubular portion, the blades of the elements of each pair being interengaged to form said unit such that a blade of one of said pair of elements extends and intersects between two adjacent blades of another of said pair of elements, wherein the tubular portion of each said element has a longitudinal axis extending along said support shaft, and first and second ends spaced along said longitudinal axis, and each said blade of said plurality of blades is elongate and is connected to and extends from said first end of said tubular portion, each said blade extending outwardly of said tubular portion at an angle to said longitudinal axis, and wherein in each said unit said first end of each element of the pair are arranged to be adjacent.

10. A barrier according to claim 9, further comprising support means for fixing the barrier to a perimeter structure, wherein said support means comprises a number of support connectors each fixed to said support shaft, and a respective support post fixed to each said support connector.

11. A barrier according to claim 10, wherein each said support connector comprises a first tubular portion in which said support shaft is arranged to extend, and a second tubular portion connected to and extending substantially at right angles to said first tubular portion and to which a respective support post is to be fixed.

12. A barrier according to claim 11, further comprising a plurality of tubular spacer members arranged to be supported on said support shaft to space adjacent units apart.

13. A barrier according to claim 12, wherein said units are spaced substantially equidistantly along said support shaft.

* * * * *